US006019148A

United States Patent [19]

Hansen

[11] Patent Number: 6,019,148

[45] Date of Patent: Feb. 1, 2000

[54] DOOR MACHINE

[75] Inventor: Michael R. Hansen, Willard, Mo.

[73] Assignee: Country Pride, Inc., Willard, Mo.

[21] Appl. No.: 09/128,301

[22] Filed: Aug. 3, 1998

Related U.S. Application Data

[60] Provisional application No. 60/054,992, Aug. 6, 1997.

[51] Int. Cl.[7] ..... B27C 9/02; B27C 5/00

[52] U.S. Cl. ..... 144/3.1; 144/134.1; 144/135.2; 144/253.2; 144/252.1; 144/371; 144/286.5; 144/347; 409/137; 409/226

[58] Field of Search ..... 144/1.1, 3.1, 134.1, 144/135.2, 252.1, 253.1, 253.2, 253.5, 367, 371, 286.1, 286.5, 345, 347; 409/137, 226

[56] References Cited

U.S. PATENT DOCUMENTS

| | | | |
|---|---|---|---|
| D. 276,529 | 11/1984 | Campbell, Jr. | D15/127 |
| D. 341,600 | 11/1993 | Wixey et al. | D15/131 |
| 1,015,927 | 1/1912 | Arbuthnot | 144/135.2 |
| 1,748,366 | 2/1930 | Salvat | 144/135.2 |
| 1,758,834 | 5/1930 | Heston et al. | 144/135.2 |
| 1,776,238 | 9/1930 | Smith | 144/135.2 |
| 1,807,561 | 5/1931 | White | 144/251.2 |
| 2,776,682 | 1/1957 | Mullen | 144/2.1 |
| 3,008,501 | 11/1961 | Hammer | 144/135.2 |
| 4,060,112 | 11/1977 | Leeper, Jr. | 144/135.2 |
| 4,271,880 | 6/1981 | Leeper, Jr. | 144/134.1 |
| 4,557,303 | 12/1985 | Gardner et al. | 144/145.2 |
| 4,655,268 | 4/1987 | Lundbloom | 144/3.1 |
| 5,396,937 | 3/1995 | Clausen | 144/253.2 |
| 5,509,454 | 4/1996 | Giacometti | 144/252.1 |

*Primary Examiner*—W. Donald Bray
*Attorney, Agent, or Firm*—Jonathan A. Bay

[57] ABSTRACT

A door machine is provided for the production of a raised-panel door product of the type having a central panel framed in a sash of left and right stiles and upper and lower rails. In this type of raised panel door, the stiles and rails are joined by four butt joints to form the sash which features four inner edges that join the four edges of the central panel in edge joints. Preferably, the rails extend between and space apart the stiles and as such, these rails have opposite "butt" edges. The door machine includes a stand and a table on the stand formed with openings. The table and stand support a power and drive assembly which includes at least driven three spindles. Each spindle has a head for mounting a knife, and this head protrudes through an opening in the table as slightly above a plane of the table. The knives include a panel knife and an associated fence for shaping all four edges of the central panel, a stile knife and associated fence for shaping each inner edge of both stiles and both rails, and a coping knife and associated fence for shaping the butt edges. Altogether, the spindle heads and fences are spatially distributed around the table to avoid interference with one another for the shaping work to be performed by each spindle.

7 Claims, 9 Drawing Sheets

DOOR MACHINE

CROSS-REFERENCE TO PROVISIONAL APPLICATION(S)

This application claims the benefit of U.S. Provisional Application No. 60/054,992, filed Aug. 5, 1997.

BACKGROUND OF THE INVENTION

The invention generally relates to a machine for making wooden, raised-panel doors such as cabinetry and the like and, more particularly, to a power machine that has multiple stations which allow multiple wood-working operations useful in an efficient process for making of wooden, raised-panel doors. An inventive aspect of the above-referenced machine is that it streamlines the process of making raised-panel doors in order to maximize efficiency.

A number of additional features and objects will be apparent in connection with the following discussion of preferred embodiments and examples.

SUMMARY OF THE INVENTION

Various aspects and objects are provided according to the invention in a door machine for the production of a raised-panel door product of the type having a central panel framed in a sash of left and right stiles and upper and lower rails. In this type of raised panel door, the stiles and rails are joined by four butt joints to form the sash which features four inner edges that join the four edges of the central panel in edge joints. Preferably, the rails extend between and space apart the stiles and as such, these rails have opposite "butt" edges. The door machine includes a stand and a table on the stand formed with openings. The table and stand support a power and drive assembly which includes at least driven three spindles. Each spindle has a head for mounting a knife, and this head protrudes through an opening in the table as slightly above a plane of the table. The knives include a panel knife and an associated fence for shaping all four edges of the central panel, a stile knife and associated fence for shaping each inner edge of both stiles and both rails, and a coping knife and associated fence for shaping the butt edges. Altogether, the spindle heads and fences are spatially distributed around the table to avoid interference with one another for the shaping work to be performed by each spindle.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

FIGS. 4 through 14 are a sequence of views showing the use of the door machine in accordance with the invention in the process of making a representative raised-panel door, wherein:

FIG. 4 is a perspective view of a panel station of the door machine;

FIG. 5 is an enlarged scale perspective view of the panel station of FIG. 4 showing panel stock resting against the knife thereof to illustrate use of the machine at the panel station;

FIG. 6 is an elevational view of the panel station comparable to FIG. 5 except from a vantage point viewing substantially along the edge of the panel which rests against the knife;

FIG. 7 is an elevational front view showing a coping station of the door machine showing the coping knife as it appears in an opening for it in its fence;

FIG. 8 is a view comparable to FIG. 7 except from a changed vantage point, showing a butt edge of a rail at rest against the coping knife thereof;

FIG. 9 is a view comparable to FIG. 8 showing details of the completed butt edge of the given rail;

FIG. 10 is a top perspective view of a stile station of the door machine, wherein a fence for the stile station is pulled back from its use position to show better the knife of the stile station;

FIG. 11 is an elevational perspective view of the stile station from a vantage point viewing substantially down an inner edge of a rail, which inner edge is resting against the stile knife to illustrate the shape that the knife gives to the inner edge;

FIG. 12 is an elevational perspective view showing how one stile (on the left in the view) joins in butt-joint fashion with the butt edge of one rail (on the right in the view);

FIG. 13 is a view comparable to FIG. 12, except showing a completed butt joint therebetween;

FIG. 14 is a top perspective view comparable to FIG. 13 except showing the central panel installed in between the stile and rail order to illustrate completion of the raised-panel door product;

DETAILED DESCRIPTION OF THE INVENTION

Figure 1:
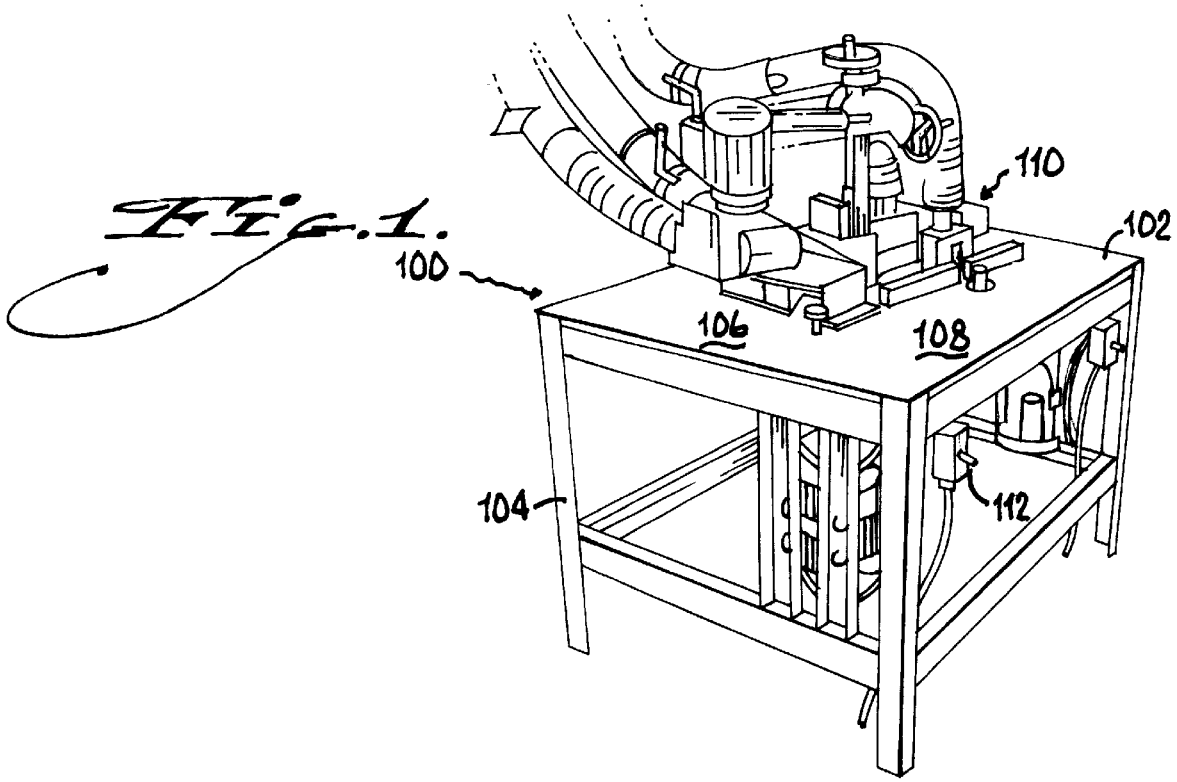
FIG. 1 is a perspective view of a door machine in accordance with the invention, for the production of wooden, raised-panel door products.
Figure 2:
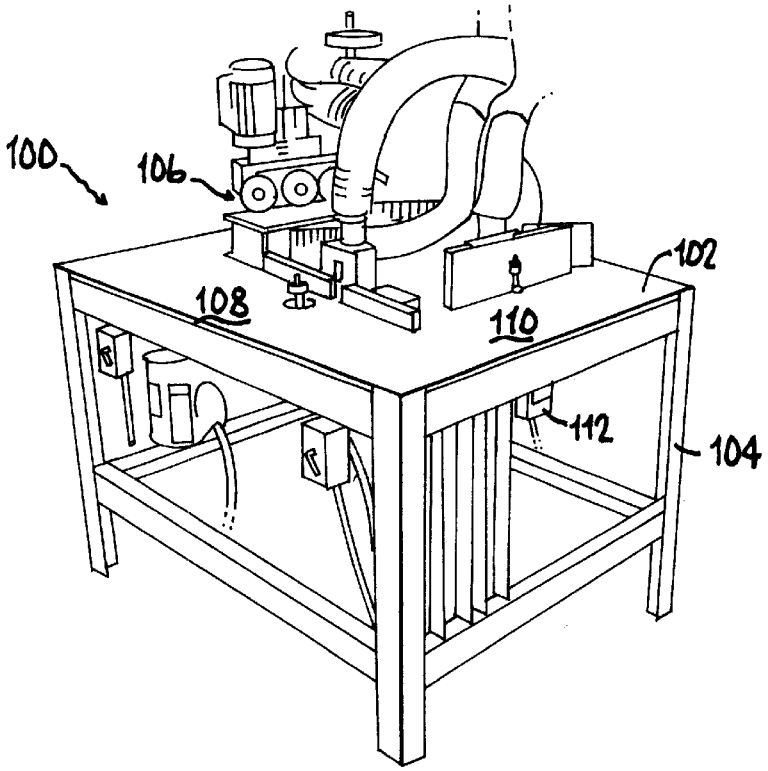
FIG. 2 is a perspective view comparable to FIG. 1 except from a different vantage point.
Figure 3:
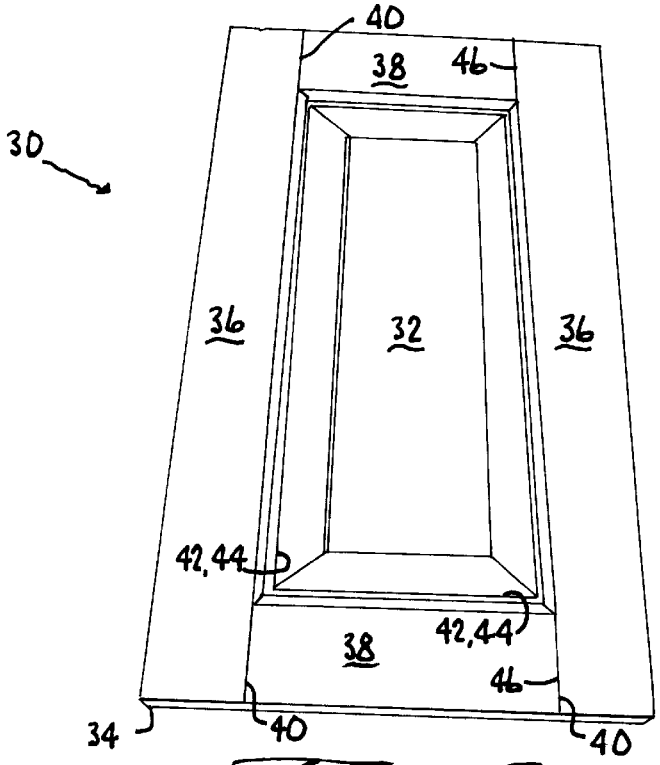
FIG. 3 is a perspective view of a completed raised-panel door product.

FIGS. 1 and 2 show a door machine 100 in accordance with the invention, for making wooden, raised-panel doors as cabinetry and the like (not shown, but indicated as 30 in FIG. 3). The door machine 100 comprises a main table 102 supported by a stand 104 that has four legs. The table 102 is a plate of steel machined substantially flat. Distributed about the table 102 there are three work stations 106, 108, and 110 which allow the performance of various wood-shaping operations as will be described more particularly below.

Briefly, however, each work station 106, 108, 110 has its own high-speed, revolving wood-cutter or "knife" (not all of which are in view) for routing or shaping an edge of stock (not shown, but see FIG. 5 though 11 below) fed past that knife. From the extreme left in FIG. 1 and continuing counterclockwise around the table, these three work stations comprise a panel station 106, a stile station 108, and a coping station 110. It is the knife of the stile station 108 that is most clearly in view. The stand 104 also supports the power and drive systems 112 that turn the knives, as will be more particularly described with reference to FIGS. 15 through 18 below. The table 102 and stand 104 are massive (e.g., heavy) to give the door machine 100 much needed stability on the floor during use.

FIG. 2 is a view comparable to FIG. 1 except from a different vantage point such that the three stations in sequence are—from the extreme right and continuing clockwise around the table—the coping station 110, the stile station 108, and the panel station 106.

FIG. 3 shows a completed raised-panel door product 30. This door product 30 is an example products producible by the inventive door machine 100 shown FIGS. 1 and 2. This door product 30 is representative of raised-panel doors generally and its exact measurements are not limiting to the doors producible by the door machine 100 in accordance with the invention, because much variation is easily possible as will be readily apparent by end of this description.

The door product 30 comprises essentially a central panel 30 surrounded by a sash 34 (eg., open frame). The sash 34 comprises left and right stiles 36 spaced by upper and lower rails 38 which mate in butt joints 40. As shown in FIG. 3 as particular to this door 30, the stiles 36 are more than twice the length of the rails 38.

Hence the door 30 comprise five component parts. These five component parts are shaped separately on the inventive door machine 100 before their final assembly together. More particularly, the central panel 32 has four formed edges 42. The left and right stiles 36 each have a single formed edge 44 (ie., the inner edge thereof). The upper and lower rails 38 have three formed edges (ie., the inner edge 44' and the opposite butt edges 46).

The table that follows summarizes which and how many operations of each station are executed on each component part, including identifying the involved edge(s) for that component part.

FIGS. 4 through 14 are a sequence of views showing the use of the door machine 100 in accordance with the invention, as in the process of producing a raised-panel door product 30 as shown by FIG. 3.

Figure 4:
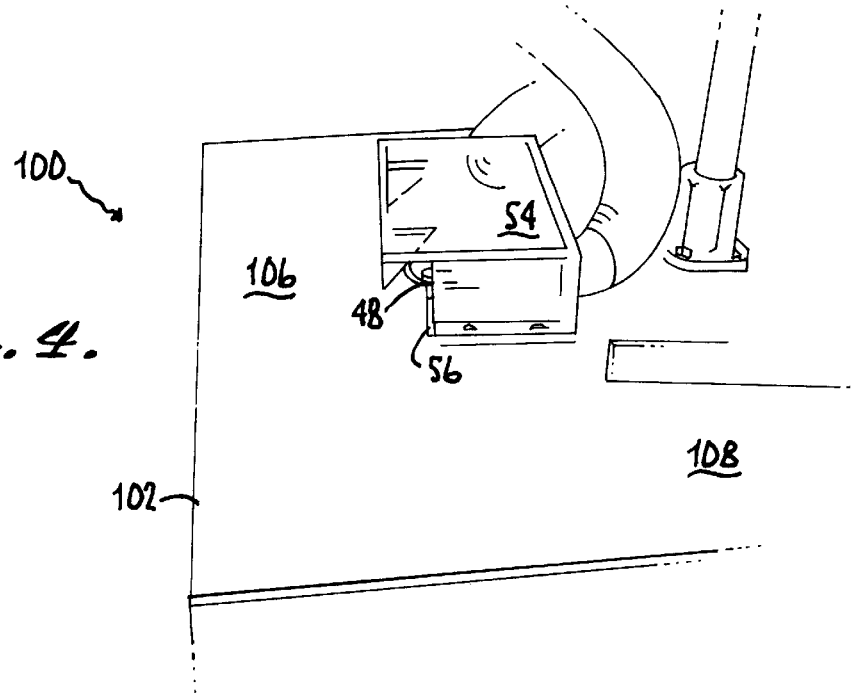

FIG. 4 is a view of the panel station 106. The panel station 106 has the biggest knife 48 of all the stations, and it turns the slowest relative to the other stations. For example, the panel knife 48 is carried on the head 52 of a spindle 50 that measures an inch-and-one-quarter in diameter (3.2 cm diam.) and that turns at 5000 rpm. For the stile and coping stations 108 and 110, their knives are carried on three-quarter inches diameter spindles (1.9 cm diam.) that turn at 7500 rpm. Unlike the other stations, the panel station 106 has a plastic cover 54 disposed over its knife 48 for suction of chips to reduce the amount of post-use clean-up as the panel knife 48 throws out the most chips.

Figure 5:
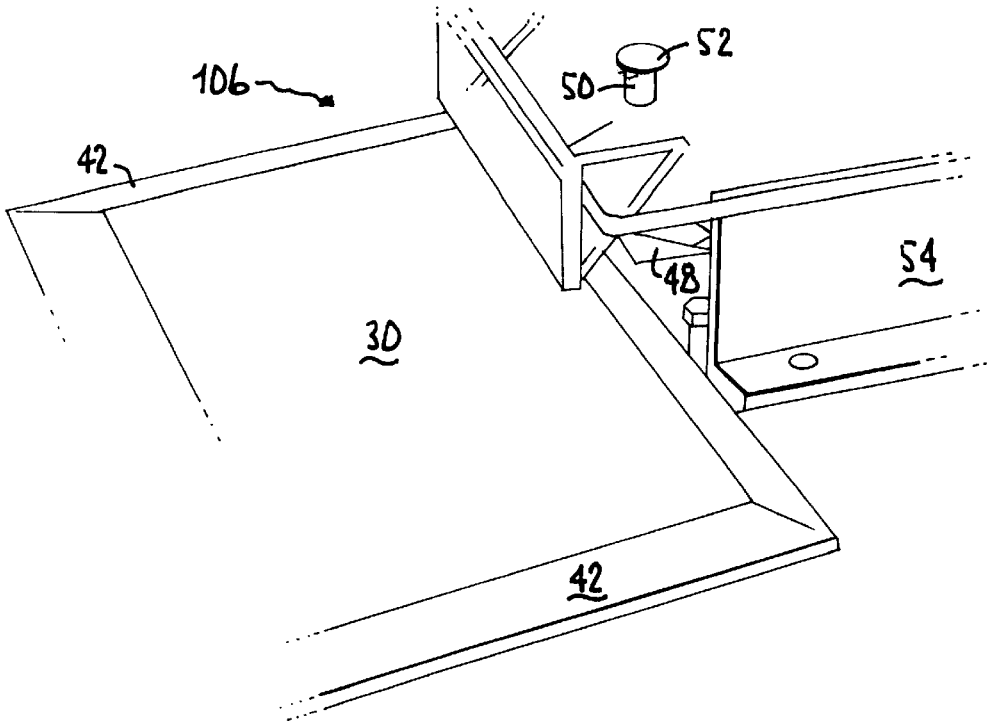

FIG. 5 is a view of the panel station 106 comparable to FIG. 4 except showing a completed panel 32 sitting at the station. In this view, the direction of feed is from upper left in the view to lower right. As said, however, this panel 32 is complete and is merely resting against the panel knife 48 (see, eg., FIG. 6) to illustrate use of the door machine 100 at the panel station 106.

Figure 6:
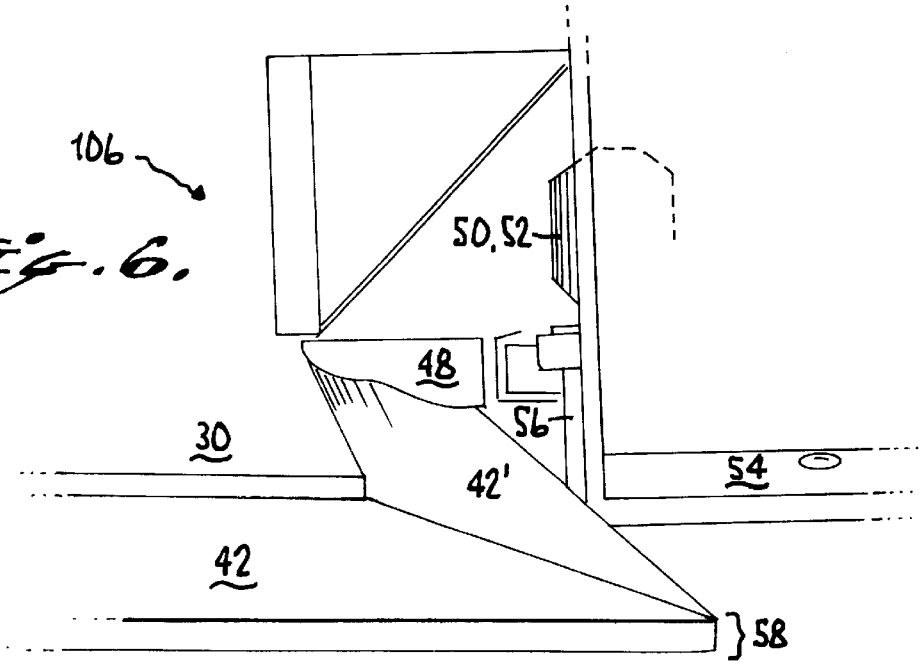

FIG. 6 is a view of the panel station 106 comparable to FIG. 5 except from an elevational vantage point viewing straight down the panel edge 42' which rests under the knife 48. Hence in this view, needless to say, power to the door machine 100 is switched OFF. This view best shows what shape the panel knife 48 gives to the edge(s) 44/44' of the panel 32. The stock piece for the panel 30 has, before shaping, four regular blank edges (not illustrated, but this original shape can be easily reckoned). At the panel station 106, the panel-stock piece has its four edges 44/44' fed past the knife 48 for shaping as shown. Each edge 44/44' of the central panel gets the same treatment. The panel 32 is run face up as shown and is fed through the panel station 106 in the direction from up (or up-left) to down (or down-right). The knife 48 turns counterclockwise. A fence is used as is known to keep the edges 44/44' aligned while moving past the knife 48, however the fence has been removed from the view. What is in view is one of the anchor bolts 56 which holds the fence down. Fences will be shown in connection with the coping station 110 (eg., FIGS. 7 or 8) and stile station 108 (eg., FIG. 11).

A critical dimension in the view of FIG. 6 is the thickness 58 of the extreme uncut edge that remains after the upper bevel-form has been cut into the panel 32's edge 44. This reduced-down thickness 58 fits into a corresponding slot (indicated as 78 in inter alia FIG. 13) for it in the rails and stiles 38 and 36. Such a slot 78 for this reduced-down thickness is shown by and described more particularly in connection with FIG. 13.

| Part name | Number of passes & through which station | involved edge(s) |
|---|---|---|
| the one panel | 4 passes[1] through panel station<br>* * * * * | all 4 outer edges |
| each rail (upper or lower) | 2 passes[2] through coping station<br>1 pass[2] through stile station<br>* * * * * | both butt edges<br>inner edge only |
| each stile (left or right) | 1 pass[2] through stile station<br>* * * * * | inner edge only |

Notes
[1]Preferably the part(s) are passed through oriented face "up."
[2]Preferably the part(s) are passed through oriented face "down."

At this point in the process, the panel 32 has been prepared sufficiently for setting aside until the rails 38 and stiles 36 are shaped. The rails 38 are taken up next, before the stiles 36. With reference back to FIG. 3, the rails 38 have three formed edges. The opposite "butt" edges 46 (i.e., the two relatively shorter edges which mate the stiles 36 in the butt joints 40) are formed by what is conventionally referred to as a "coping" operation.

Figure 7:
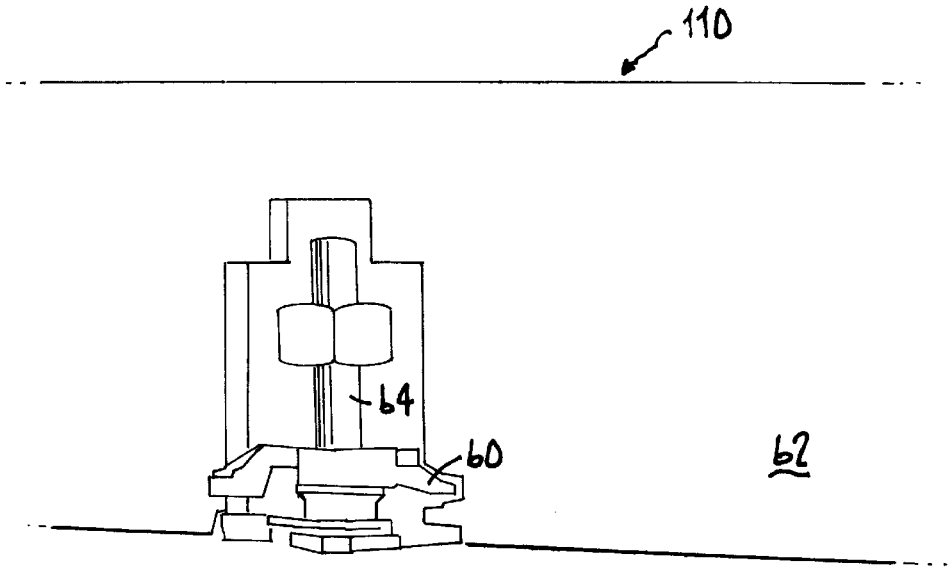

FIG. 7 is an elevational front view showing the coping knife 60 as it appears in an opening for it in its fence 62. As previously stated, the coping knife 60 is carried on a spindle 64 that measures three-quarter inches in diameter (1.9 cm diam.) and that turns at 7500 rpm. The coping knife 60 "copes" or shapes a mirror opposite profile of what the stile knife (indicated as 68 in FIG. 10) shapes because the corresponding tongue-formations and groove-formations produced by the coping knife 60 ought to match exactly with the reverse image groove-formations and tongue-formations produced by the stile knife 68 in the stiles 36 (which are not shown, but see FIGS. 10 and 11 below, as well as the assembly views of FIGS. 12 through 14 hereinbelow).

Figure 8:
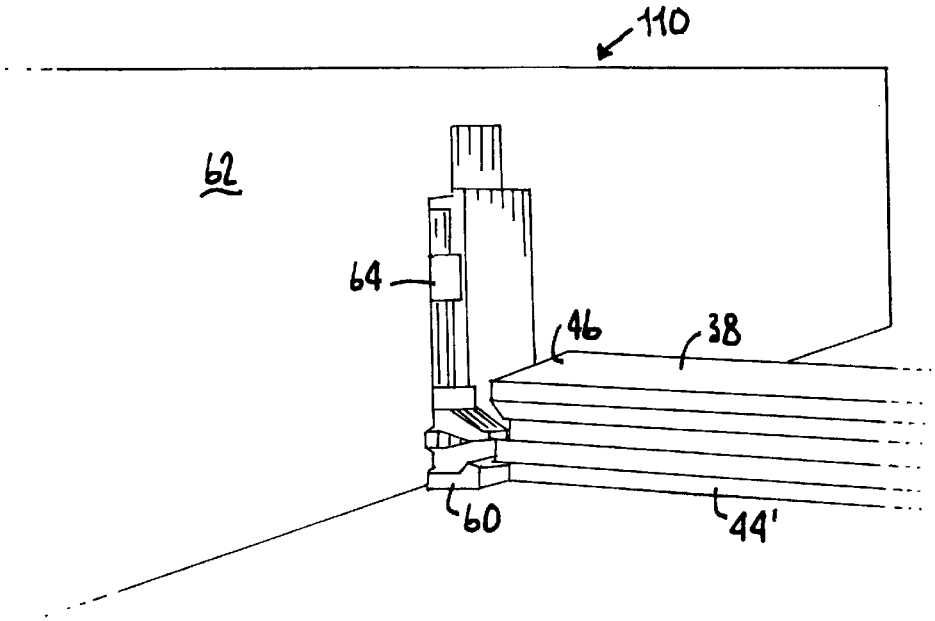
Figure 9:
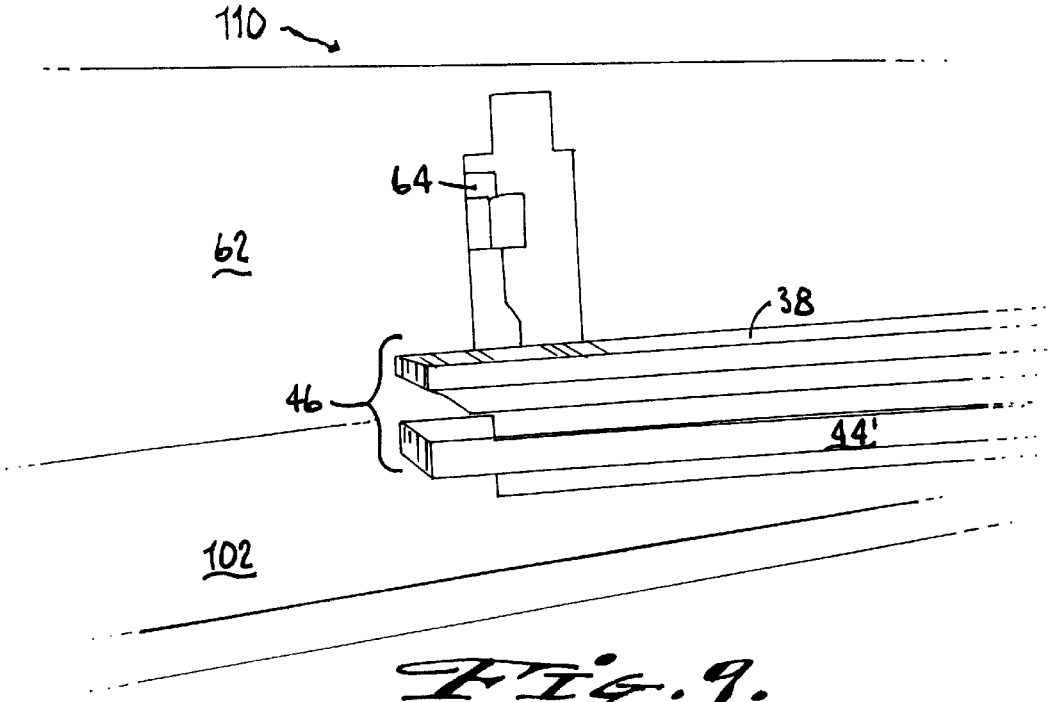

FIG. 8 is a view comparable to FIG. 7 except from an oblique elevational vantage point, showing a completed butt edge 46 of a rail 38 at rest, with the coping knife 60 inserted therein. FIG. 9 shows a detail of a completed butt edge 46 of the given rail 38. As stated, the butt edges 46 of each rail 38 are fed through the coping station 10 before the inner edge 44' thereof is shaped at the stile station 108. However, the inner edge 44' in these views has been previously completed. For convenience in this description, a completed rail 38 has been set against the coping knife 60 after power to the door machine 100 has been switched OFF to simulate how shaping takes place during real-time work. Accordingly, the depiction here of a completed inner edge 44' is not meant to contradict the written description hereof.

As depicted here, the rail 38 is run face up while both its butt edges 46 are passed by the coping knife 60 (Nb., the coping knife 60 turns counterclockwise). It is preferred however, that the coping knife 60 be inverted so that the butt edges 46 can be run face down past the knife 60. That way, it is easier to insure that the stiles 36 and rails 38 will match up as desired with flush faces at the seams of all four butt joints 40.

At this point in the process, the butt edges 46 of the rails 38 have been completed, and so has work at the coping station 110. Attention is next turned to the stile station 108.

Figure 10:
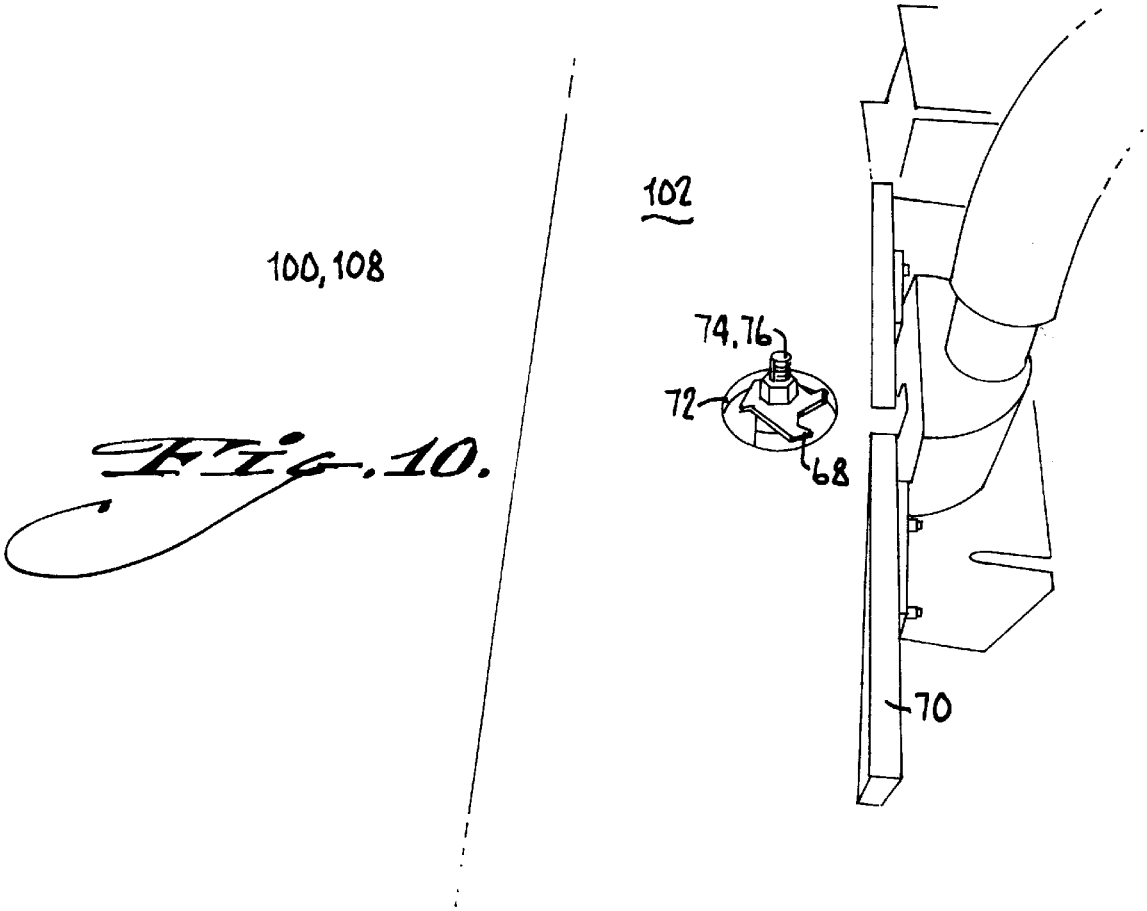

FIG. 10 is a plan view of the stile station 108. At the stile station 108, each rail 38 is passed through once to shape its inner edge 44'. Also, each stile part 36 has to be picked up for the first and only time so that the inner edge 44 thereof can be shaped by the stile knife 68.

The stile station 108 includes the stile knife 68 and a fence 70. In this view, the fence 70 is pulled back from its use position. The stile station 108 is like the other stations in that the table 102 features a clearance hole 72 through itself for closely surrounding the knife 68. The spindle 74 of course is mounted to the stand 104 at an elevation below table top 102. All of the spindle 74 that protrudes above the plane of the table 102 is its head 76 (the portions of the head 76 that are in view are threaded, and a nut is twisted onto those threads). Naturally the stile spindle 74 has the stile knife 68 mounted to it. The clearance hole 72 in the table 102 is sized to closely surround and allow clearance of the knife 68 as it turns under power.

Figure 11:
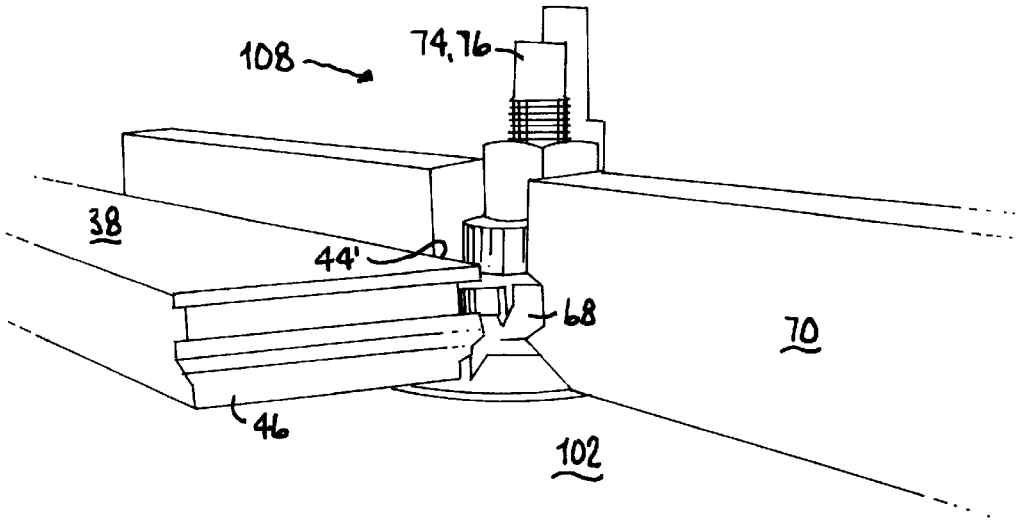

FIG. 11 is a view of the stile station 108 comparable to FIG. 10 except from an elevational vantage point viewing the inner edge 44' of a rail 38 resting against the stile knife 68. The inner edge 44' has been previously completed and it features the tongue-formations and groove-formations given to it by the stile knife 68. Both the upper and lower rails 38 as well as the left and right stiles 36 are passed by the stile knife 68 just once. And that one pass is only just along the inner edge 44/44' of each. The rails and stiles 38 and 36 are preferably run face down to allow more precise control over the measure of how far back from the plane of the front faces of the rails and stiles 38 and 36 will be the location for the slot 78 for the reduced-down thickness 58 of the panel 32 (see, eg., FIG. 6). This slot 78 is more particularly shown and discussed in connection with FIG. 13.

Figure 12:
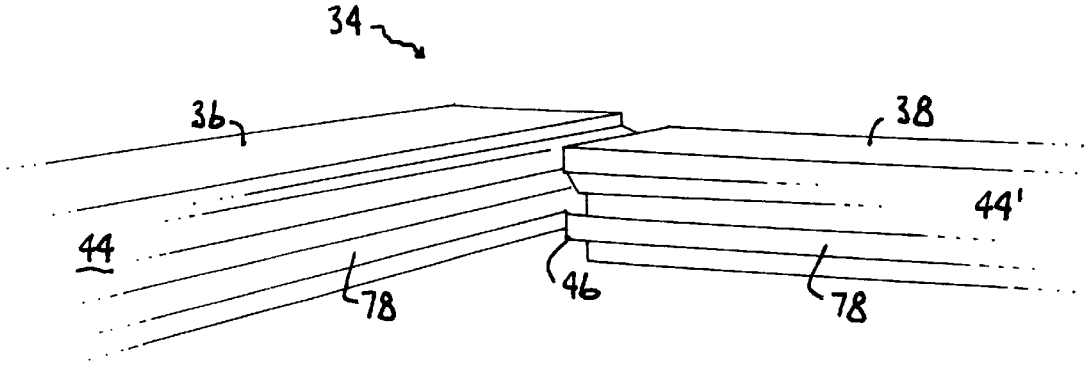

FIG. 12 is an elevational view showing, for illustrative purposes only, how one stile 36 (on the left in the view) assembles with one rail 38 (on the right). The stile 36 and rail 38 are shown face up. In actual assembly, the central panel 32 would also be involved (not shown here, but see FIG. 14). The rail 38's butt edge 46 has been coped or shaped to match or conform closely to the profile or contour of the stile 36's inner edge 44, as shown.

Figure 13:
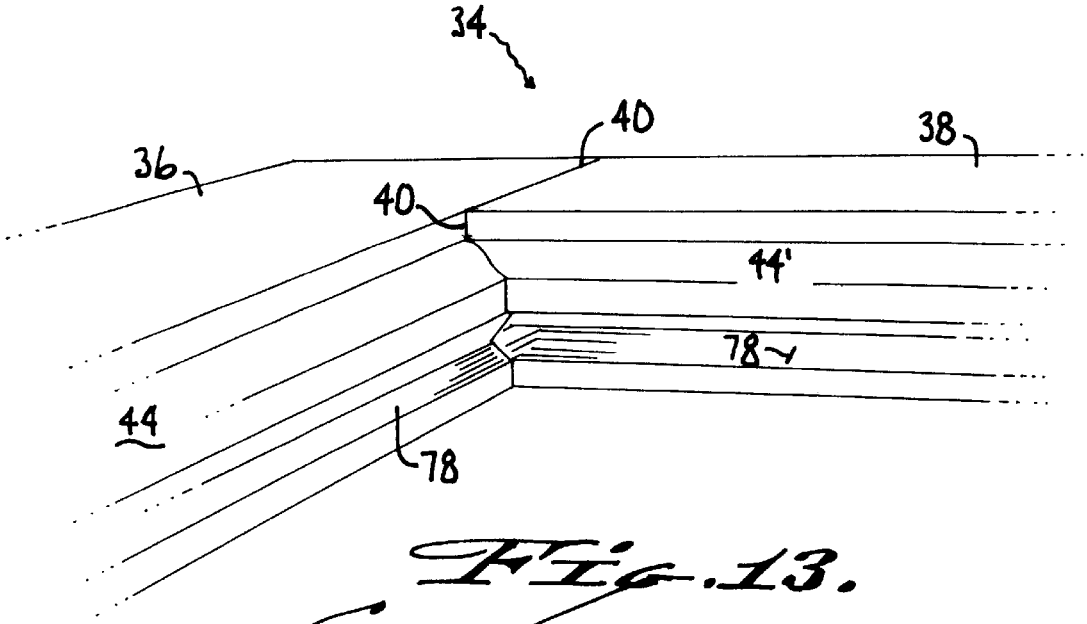

FIG. 13 is a view comparable to FIG. 12, except showing how close the conformance or fit is between the stile 36 and rail 38. Together the stiles 36 and rails 38 make up the sash border 34 that frames the central panel 32 (not shown) when it is installed. The stile 36 and rail 38 cooperatively define a continuous slot 78 which extends in a rectangular circuit. The reduced-down thickness 58 edges 42 of the panel 32 (not shown, but see FIG. 6) insert into the slot 78. It is critical for fine cabinetry that the front faces of the stiles 36 and rails 38 lie in a common plane to give the sash 34 overall a high degree of flushness, especially at the seams of the butt joint(s) 40. It detracts from aesthetics of the cabinetry if the seams 40 between the rails 38 and stiles 36 are uneven on the front face. It less important if this seam 40 is uneven on the back. When it happens that the rails 38 and stiles 36 are uneven on the back, this condition merely indicates that the stile stock 36 was minutely thicker or thinner than the rail stock 38. In order to compensate for variations in thickness (or thinness) in the rail and stile stock 38 and 36, it is preferred if the knives 60 and 68 of the coping and stile stations 110 and 108 are set up to shape the rails and stiles 38 and 36 when fed face down. That way, the desired flushness at the seams 40 between stiles 36 and rails 38 can achieved with better control. Variations in thickness of the rail and stile stock 36 and 38 can be hidden better, ie., on the back sides.

Figure 14:
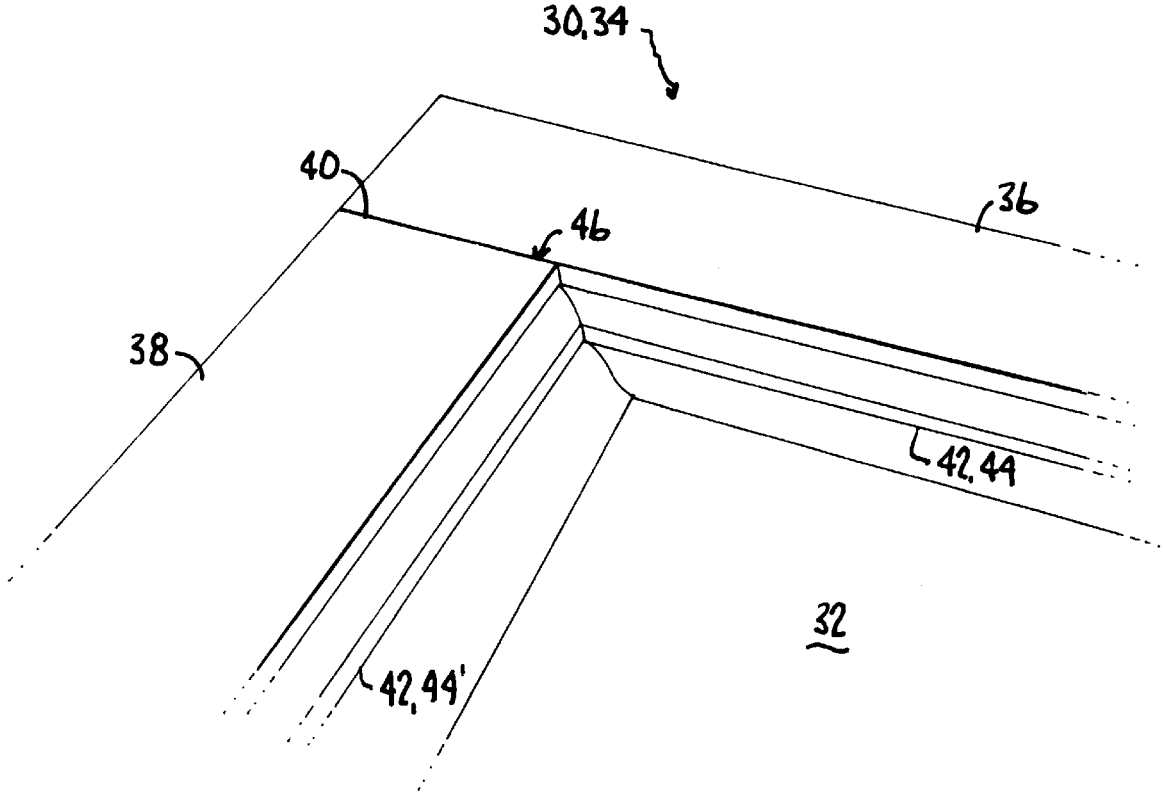

FIG. 14 is a view comparable to FIG. 13 except showing the central panel 32 installed in order to complete the assembly of the raised-panel door 30. Following FIG. 13, the stiles 36 and rails 38 were disassembled and then re-assembled around the central panel 32, as shown in this view. Completion of the assembly 30 involves gluing up the component parts, as well as clamping them and nailing them if or as desired to insure tightness.

Figure 15:
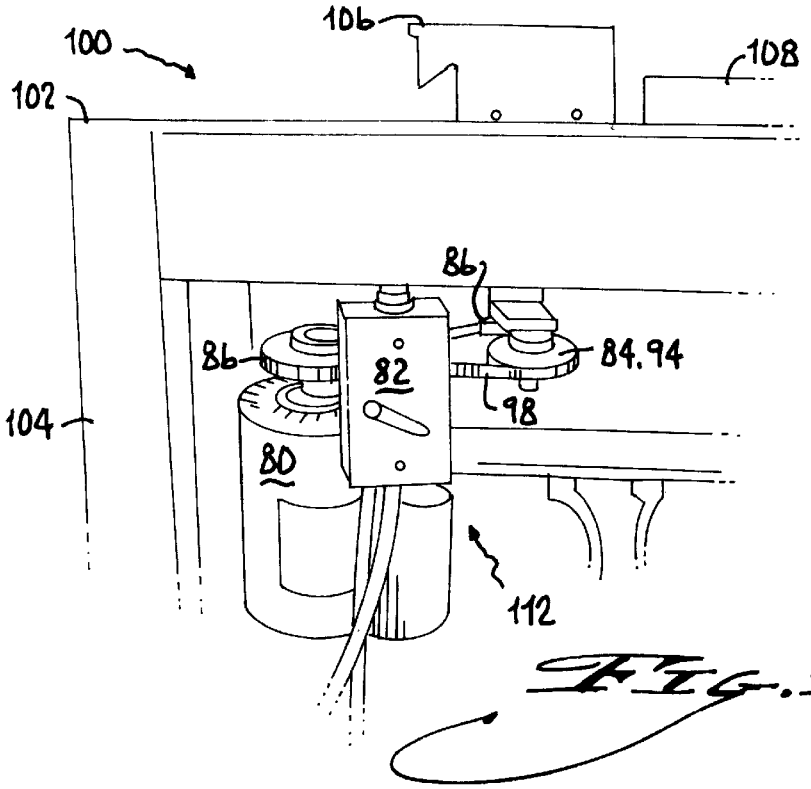
FIG. 15 is a side elevational view the door machine in accordance with the invention, as viewing the panel station from one side (it is also viewing the front of the stile station, but most of the stile station is out of view to the right), to depict one motor, a switch for that motor, and a belt drive for transmitting the drive output of the motor to the spindle that turns the panel knife.
Figure 18:
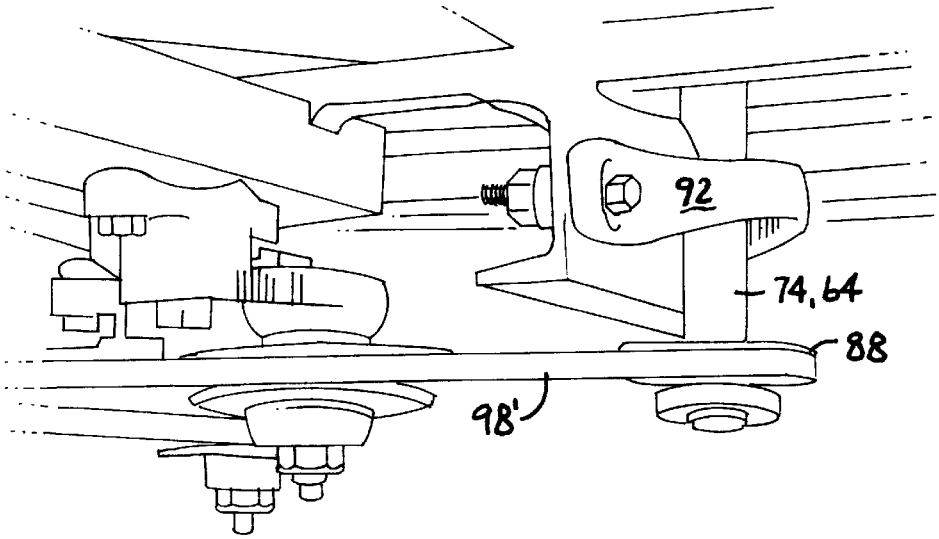
FIG. 18 is an enlarged scale bottom perspective view comparable to FIG. 17 except focusing in on one of the pillow blocks for a spindle of either the stile station or the coping station.

FIGS. 15 and 18 are various views of the stand 104 for the table 102 to better show the power and drive assemblies 112 for the door machine 100. The power and drive assemblies 112 comprise two motors 80 and 80', two switches 82 and 82' (one for each motor), and various arrangements of belt drive systems 84.

Figure 16:
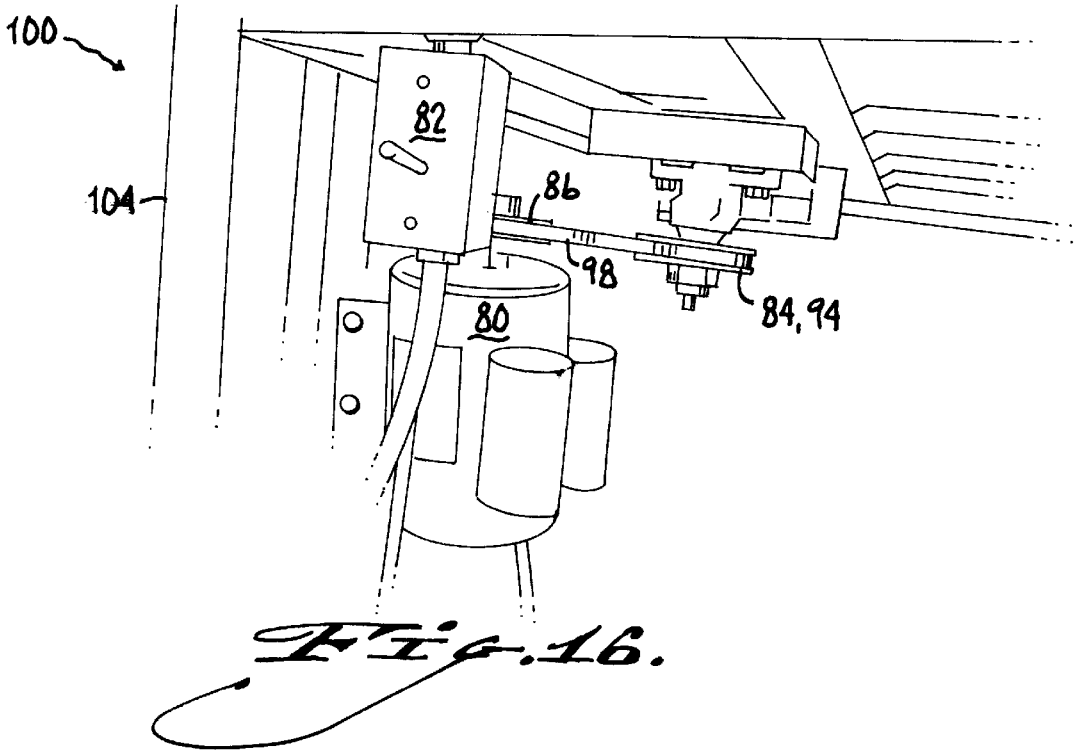
FIG. 16 is a bottom perspective view comparable to FIG. 15 except from a relatively lower vantage point to allow viewing of the pillow block that carries the spindle for the panel knife.

FIGS. 15 is an elevational view the door machine 100 in accordance with the invention, as viewing the panel station 106 from one side. FIG. 16 is a bottom perspective view comparable to FIG. 15 except from a relatively lower vantage point. These views show one motor 80, a switch 82 for that motor 80, and a belt drive 84 for transmitting the drive output of the motor 80 to the spindle 50 that turns the panel knife 48. The power of the motor 80 is rated at 5 HP, and it turns at about 1750 rpm. The belt drive 84 comprises a drive pulley 88 on the motor 80 and a driven pulley 88 suspended from the lower termination of the spindle 50. The sizes of the pulleys 86 and 88 are chosen to rate up the speed of the spindle 50 to 5000 rpm. The panel-station spindle 50 is one-and-one-half inches in diameter (3.8 cm diam.) where attached to the driven pulley 88. At its head 52, however, the panel-station spindle 50 is reduced down to one-and-one-quarter inches diameter (3.2 cm diam.), which is the diameter that inserts into a central bore-hole in the panel knife 48. The panel knife 48 is mounted on the reduced-down section and can either be directly rested on or shimmed up off a shoulder at the demarcation of the reduced-down section. The proper elevation of the panel knife 48 is adjusted by adding or subtracting shims between the shoulder and the knife 48, as is well-known. FIG. 16 allow a better view of the pillow block 92 that carries the spindle 50 for the panel knife 48.

Figure 17:
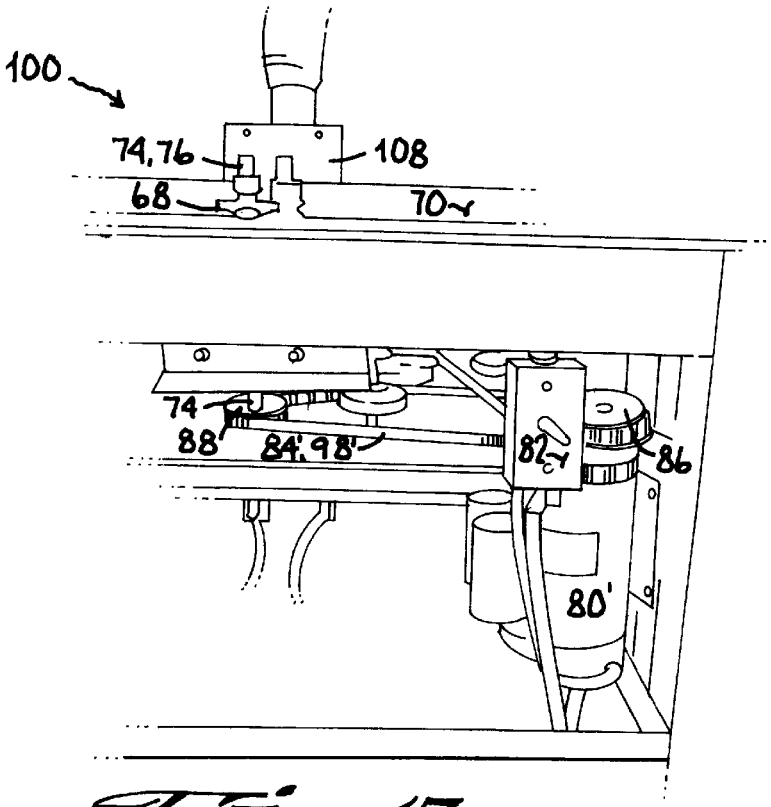
FIG. 17 is an elevational perspective view of the inventive door machine, as viewing the front of the stile station and as viewing the coping station from one side, for depicting another motor for the door machine, a switch for that motor, and the belt drive for transmitting the drive output of this motor to the spindles of the stile and coping stations.

FIG. 17 is an elevational view the door machine 100, as viewing the front of the stile station 108 and as viewing the coping station 110 from one side. The view shows the other motor 80' of the two motors for the door machine 100, a switch 82' for that motor 80', and the belt drive 84' for transmitting the drive output of this motor 80' to the spindles 74 and 64 of the stile and coping stations 108 and 110. The motor 80' turns at about 1750 rpm. The belt drive 84' comprises two drive pulleys 86' on the motor shaft, two belts 98, two idlers 94, and two driven pulleys 88', one each suspended from the lower termination of the stile and coping spindles 74 and 64, respectively. The sizes of the pulleys 86' and 88' are chosen to rate up the spindle speeds to 7500 rpm, each. The coping and stile spindles 64 and 74 are one inch in diameter (2.5 cm diam.) where attached to the driven pulleys 88'. At their upper ends, however, the spindles 64 and 74 are turned down to three-quarter inches diameter (1.9 cm diam.), which is the diameter that inserts into center holes in the knives 60 and 68. The knives 60 and 68 are mounted on reduced-down sections on the spindles 64 and 74 and typically are shimmed up off a shoulder at the demarcation of the reduced-down sections. The proper elevations of the knives 60 and 68 are adjusted by adding or subtracting shims between the shoulder and knife, as is known and as previously stated above in connection with the panel knife 48.

FIG. 18 is a bottom perspective view comparable to FIG. 17 except from a relatively lower and closer in vantage point, showing one of the pillow blocks 92' used for supporting either the stile spindle 74 or coping spindle 64 (the other pillow block being substantially identical). The spindle in view here (and representative of all three) is locked in place in the associated pillow block 92' by reliance on collars 96 set in fixed positions on the spindle by set screws (not in view). Also in view is an idler or tensioning pulley 94 which allows for adjustment of the relative slackness or tension in the drive belt 98.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A door machine for the production of a raised-panel door product of the type having a central panel with four edges which are framed in four interior edges of a rectangular sash of left and right stiles and upper and lower rails wherein the stiles and rails are joined by four butt joints, the door machine comprising:

a stand;

a table on the stand formed with openings;

a power and drive assembly comprising one or more drive motors and at least three spindles operatively connected to and driven to spin by the one or more drive motors, each spindle having a head for mounting a knife and being supported by the stand and table such that each head protrudes through openings in the table and above a plane of the table;

a panel knife mounted on one spindle and associated fence means for mounting on the table in such spatial relation to the panel knife as to provide a configuration sufficient for shaping all four edges of each central panel;

a stile knife mounted on another spindle and associated fence means for mounting on the table in such spatial relation to the stile knife as to provide a configuration sufficient for shaping each inner edge of both stiles and both rails;

a coping knife mounted on a different spindle and associated fence means for mounting on the table in such spatial relation to the coping knife as to provide a configuration sufficient for shaping at least four given butt edges chosen from a group consisting of the two stiles and two rails;

wherein the spindle heads and fences are spatially distributed around the table to avoid interference with one another for the shaping work to be performed by each spindle.

2. The door machine of claim 1, wherein the stile and coping knives are mounted inverted such that the interior edges of the stiles and rails are shaped with the stile and rails run face down.

3. The door machine of claim 2, wherein the panel knife is mounted upright such that all four edges of each central panel are shaped with the central panel run face up.

4. The door machine of claim 2, wherein the coping knife is arranged to shape a cope that is a mirror opposite match of the shape produced by the stile knife.

5. The door machine of claim 2, wherein the power and drive assembly includes at least two motors.

6. The door machine of claim 2, wherein the fence means comprises a separate fence for each spindle.

7. The door machine of claim 2, wherein the at least three separate fences are spatially arranged to define a rectangular-U shape on the table.

* * * * *